US005769662A

United States Patent [19]

Stabile et al.

[11] Patent Number: 5,769,662

[45] Date of Patent: Jun. 23, 1998

[54] SNAP TOGETHER COAXIAL CABLE CONNECTOR FOR USE WITH POLYETHYLENE JACKETED CABLE

[75] Inventors: David J. Stabile, Horseheads; Ronald Peter Locati, Elmira, both of N.Y.

[73] Assignee: Augat Inc., Mansfield, Mass.

[21] Appl. No.: 680,486

[22] Filed: Jul. 15, 1996

Related U.S. Application Data

[60] Provisional application No. 60/015,747, Apr. 9, 1996.

[51] Int. Cl.[6] ..... H01R 17/04

[52] U.S. Cl. ..... 439/578

[58] Field of Search ..... 439/578, 583, 439/584, 585

[56] References Cited

U.S. PATENT DOCUMENTS

| | | | |
|---|---|---|---|
| 3,054,981 | 9/1962 | Malek et al. | 439/585 |
| 4,834,675 | 5/1989 | Samchisen | 439/578 |
| 4,902,246 | 2/1990 | Samchisen | 439/578 |
| 5,470,257 | 11/1995 | Szegda | 439/578 |
| 5,651,698 | 7/1997 | Locati et al. | 439/578 |

*Primary Examiner*—Gary F. Paumen
*Assistant Examiner*—Tho D. Ta
*Attorney, Agent, or Firm*—Weingarten, Schurgin, Gagnebin & Hayes LLP

[57] ABSTRACT

A snap together cable connector for polyethylene jacketed cable, such as used in cable television systems in Europe, is comprised of a sleeve which snap fits into a first end of a collar. The collar further includes a post which is shorter in length than convention coaxial cable connectors, thus the European 8 mm cable and its associated stiff polyethylene jacket are more easily insertable. Also included as part of the collar is a back insulator for insulation of the coaxial connectors center conductor. The connector further includes a nut which fits over a second end of the collar. The nut includes a stem and an insulator. A terminal is fit within the insulator, the terminal making contact with the center conductor of the coaxial cable when the connector is assembled. O-rings are provided between the collar and sleeve connection, and between the collar and nut connection. The sleeve includes an internal annular ridge to aid in environmental sealing and to minimize RF signal loss.

8 Claims, 4 Drawing Sheets

SNAP TOGETHER COAXIAL CABLE CONNECTOR FOR USE WITH POLYETHYLENE JACKETED CABLE

CROSS-REFERENCE TO RELATED APPLICATIONS

This application is based on Provisional Application Ser. No. 60/015,747 filed on Apr. 9, 1996.

FIELD OF THE INVENTION

The invention relates generally to electrical connectors, and more particularly to coaxial cable connectors used in conjunction with either semi-rigid coaxial cable or rigid coaxial cable.

BACKGROUND OF THE INVENTION

Coaxial cables typically comprise a central conductor which is surrounded by a metallic outer conductor. A dielectric separates the central conductor from the outer conductor, and an insulating jacket covers the outer conductor. The outer conductor is usually in one of two forms, either a copper braid or an aluminum sheath.

Coaxial cables of this type are used broadly, especially in cable television applications, and provides for high quality transmission of video and other signals. In order to effectively use the cables, a connector must be fitted to at least one end of the cable. A connector, in order to be practical, must provide for a reliable mechanical and electrical connection as well as being simple to install and use.

The coaxial cable typically in use for cable television (CATV) purposes in Europe has a polyethylene jacket which is very stiff in comparison with the coaxial cable usually used in the United States which typically has a more pliable polyvinyl chloride jacket. Accordingly, connectors used with polyvinyl chloride jacketed coaxial cables are not easily utilized for making connections to polyethylene jacketed coaxial cables.

Snap together connectors, such as those described in U.S. Pat. Nos. 4,834,675 and 4,902,246 to Samchisen, are known in the art and are known as Snap-n-Seal connectors. The Snap-n-Seal connectors are easily assembled, having a sleeve which is snap fit into a collar, include o-rings for sealing out moisture, and are comprised of a metallic post, collar, sleeve and nut. U.S. Pat. No. 5,470,257 to Szegda also describes a snap together connector. The Szegda connector also includes o-rings for sealing out moisture and are comprised of a metallic post, collar, nut and sleeve.

SUMMARY OF THE INVENTION

A snap together coaxial cable connector is disclosed. The connector is made to be easily utilized with the stiff jacketed coaxial cable such as the polyethylene jacketed coaxial cable used in Europe. The connector utilizes a post that is shorter in length than the post used in polyvinyl chloride jacketed connectors, thereby allowing the polyethylene jacketed cable to be easily mated with the connector assembly. As the connector pieces are mated together a secure connection between the connector and the coaxial cable is produced. The connector can be embodied in a variety of sizes to suit various cable types and can be configured for flexible drop cables, splice connectors, and feed-through connectors.

BRIEF DESCRIPTION OF THE DRAWINGS

The invention will be more fully understood from the following detailed description taken in conjunction with the accompanying drawings in which.

DETAILED DESCRIPTION OF THE INVENTION

Figure 1:
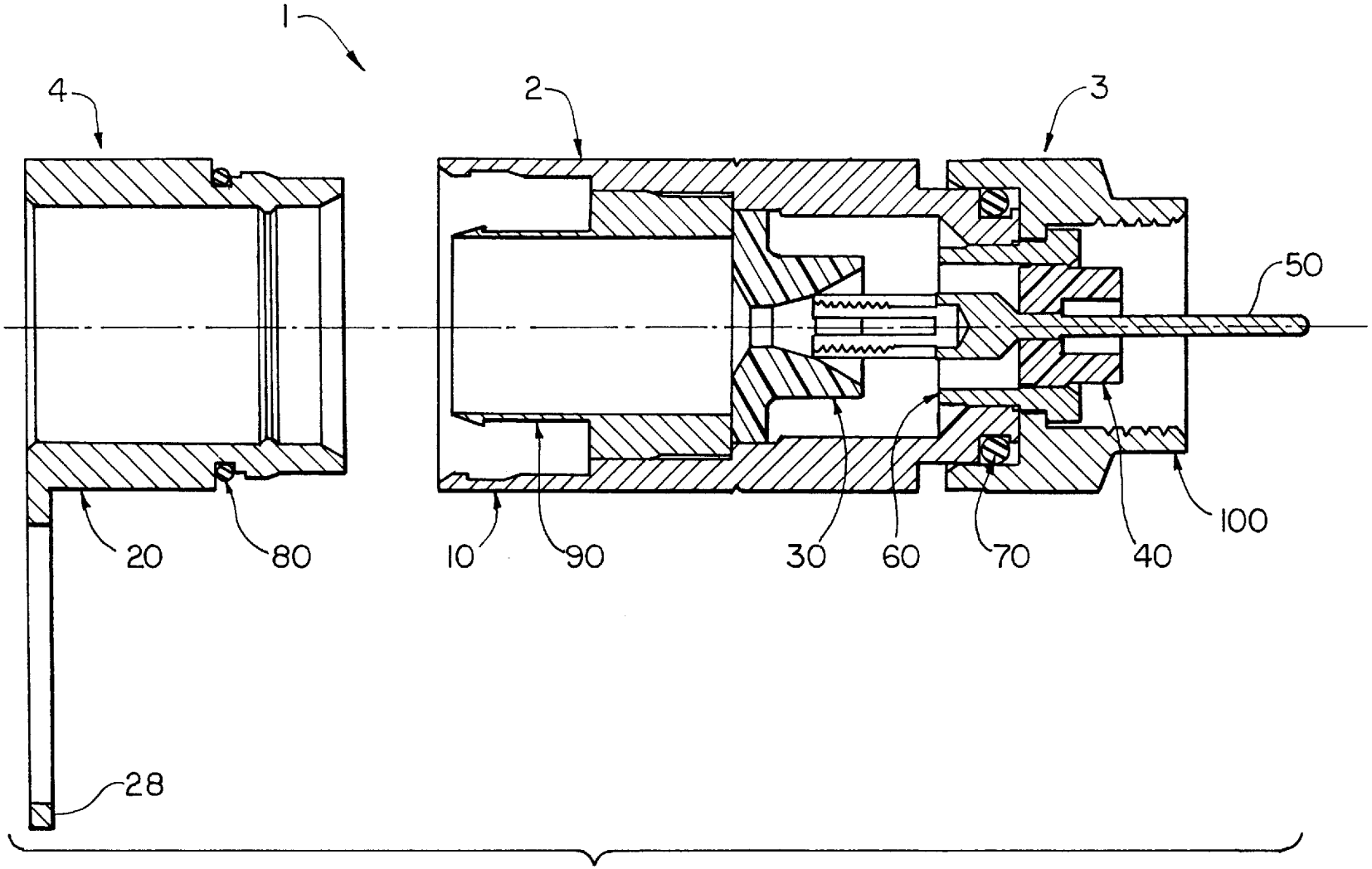
FIG. 1 is a cross-sectional view of the connector of the present invention.

FIG. 1 illustrates a snap-together coaxial connector 1 according to the present invention. A first piece 2 of the connector 1 comprises a collar 10, a post 90, a back insulator 30 and a first o-ring 70. A second piece 3 of the connector 1 comprises a nut 100, a terminal 50, an insulator 40, and a stem 60. A third piece 4 of the connector 1 comprises a sleeve 20 including a second o-ring 80, with the sleeve configured to be snap fit into the proximal end of collar 10.

Figure 2:
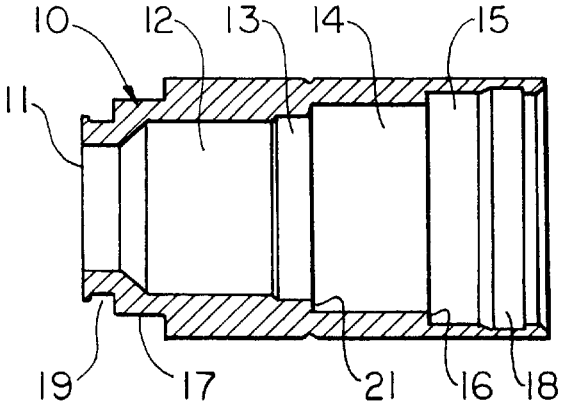
FIG. 2 is cross-sectional view of the collar.
Figure 2A:
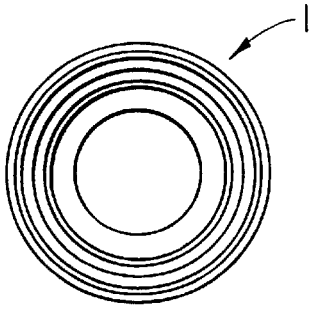
FIG. 2A is an end view of the collar of FIG. 2.

The collar 10, shown in FIGS. 2 and 2A, is comprised of brass or other conductive material. The collar 10 is open on each of two ends and has a first central bore 11 disposed therethrough. First central bore 11 is configured to fit stem 6 therein. A second central bore 12, having a larger diameter than first central bore 11 is disposed from a second end of the collar 10 a predetermined distance into the collar 10. A third bore 13 is disposed from the second end of the collar 10 a predetermined distance into the collar 10. Third bore 13 has a larger diameter than second bore 12 and is configured to fit a first end of back insulator 30 therein. A fourth bore 14 is disposed from the second end of collar 10, and is configured to accommodate the first end of post 90. Fourth bore 14 is larger in diameter than third bore 13, and provides for a first annular shoulder 21 where fourth bore 14 meets third bore 13. A fifth bore 15 is disposed from the second end of collar 10 and extends a predetermined distance into the collar 10. Fifth bore 15 has a larger diameter than fourth bore 14 and thus provides a second annular shoulder 16 where fifth bore 15 meets fourth bore 14. The interior surface of fifth bore 15 also includes an interior annular groove 18.

An exterior annular groove 19 is provided proximate the first end of collar 10. Exterior annular groove 19 is configured to receive a first o-ring (not shown) therein. Proximate the exterior annular groove 19 is a flat exterior surface 17 which is configured to be received into a cooperating first end of nut 100. A retaining ring 28 which is integrally formed with the sleeve 20 may be fit onto the flat exterior surface 17 prior to the collar 10 being mated with nut 100, thereby maintaining the sleeve 20 as part of the connector assembly prior to assembly of the connector in order to prevent loss or misplacement of the sleeve.

Figure 3:
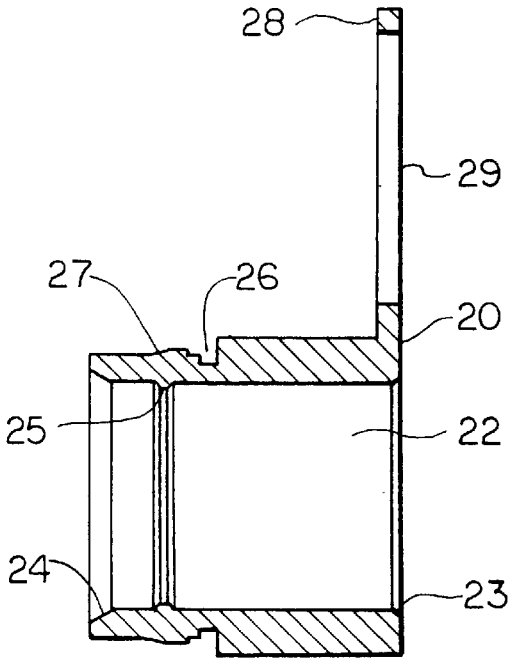
FIG. 3 is a cross-sectional view of the sleeve.
Figure 3A:
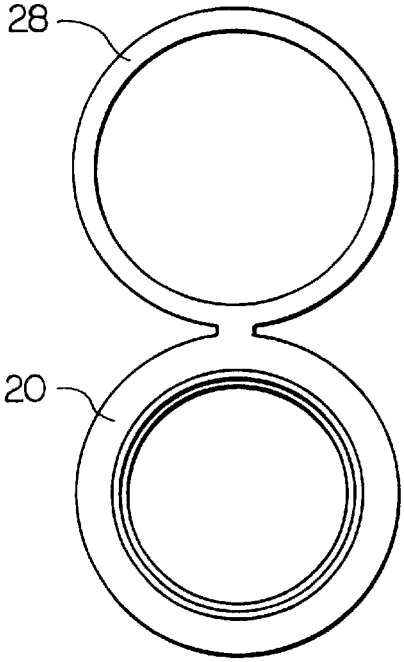
FIG. 3A is an end view of the sleeve of FIG. 3.

Referring now to FIGS. 3 and 3A, sleeve 20 is shown. Sleeve 20 is open on each of two ends and has a central bore 22 disposed therethrough. Central bore 22 includes a flared end 23 to aid insertion of a coaxial cable into a second end of the sleeve 20, and also includes a flared end 24 to aid insertion of the sleeve 20 into the connector collar 10. An interior surface of the central bore 22 includes an annular ridge 25 which is configured to provide an environmental seal between the sleeve and a coaxial cable, as well as preventing RF signal loss or degradation. Sleeve 20 also includes an annular groove 26 which is configured to retain a second o-ring 80. The exterior surface of sleeve 20 further includes an exterior annular ridge 27, the ridge configured to snap fit into the interior annular groove 18 of the collar 10 when the connector 1 is assembled. A retaining ring 28 may also be provided. The retaining ring 28 is integrally formed with the sleeve 20 and is disengagable from the sleeve 20. The retaining ring 28 includes a bore 29 extending therethrough, the bore 29 configured such that the retaining ring 28 is fit onto annular flat area 17 of collar 10. A first end of sleeve 20 is configured to receive a coaxial cable, and a second end of sleeve 20 is configured to provide a tight snap fit with collar 10, thereby securing the coaxial cable to the connector 1.

Figure 4:
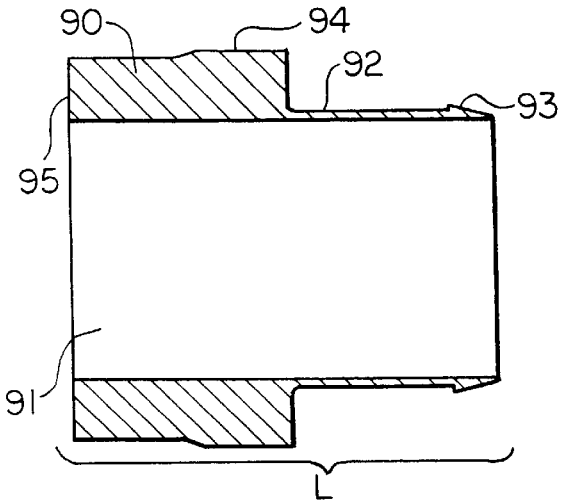
FIG. 4 is a cross-sectional view of the post.
Figure 4A:
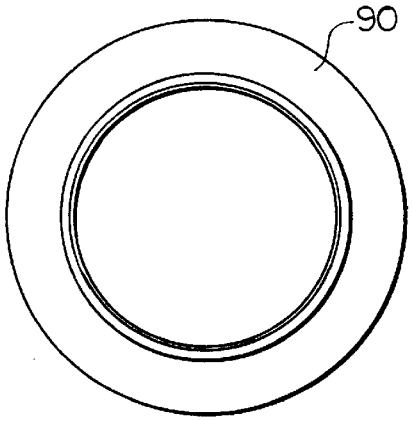
FIG. 4A is an end view of the post of FIG. 4.

Referring now to FIGS. 4 and 4A, post 90 is shown. Post 90 is is comprised of an electrically conductive material and is open on each of two ends and includes a central bore 91 disposed therethrough. Central bore 91 is configured to fit a center conductor and dielectric insulator of a coaxial cable therein. A first end 95 of post 90 is configured to be received within bore 14 of collar 10 with first end 95 abutting first annular shoulder 21. A second end 92 of post 90 is configured to fit between the dielectric insulator and conductive shield of a coaxial cable. The second end 92 of post 90 also includes a flared end 93 to aid insertion of the post 90 in the cable between the conductive shield and dielectric insulator.

Post 90 has a length L that is shorter than convention coaxial cable connectors and thus works well when utilized with coaxial cables having a stiff outer jacket, such as a polyethylene jacketed coaxial cables common in Europe. For example, conventional connectors typically include a post having a length of approximately 0.71 inches, whereas the post of the present application has a length of approximately 0.487 inches. Post 90 is configured to be shorter, thinner and with only a single barb as compared with conventional connectors in order to allow the connector to easily fit on to coaxial cables having stiff outer jackets, such as the polyethylene jacketed cables used in Europe.

Figure 5:
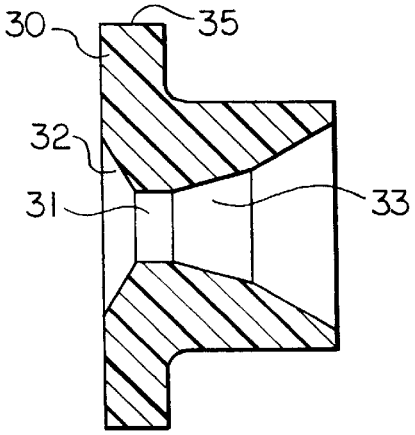
FIG. 5 is a cross-sectional view of the back insulator.
Figure 5A:
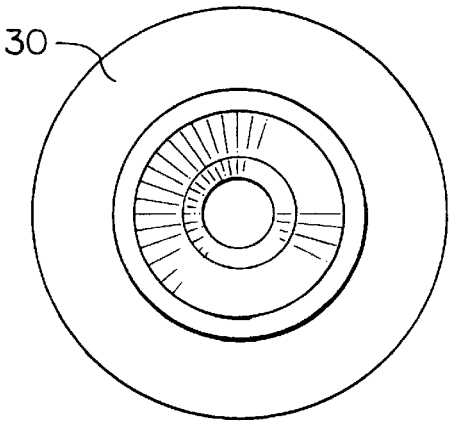
FIG. 5A is an end view of the back insulator of FIG. 5.

Referring now to FIGS. 5 and 5A back insulator 30 is shown. Back insulator 30 is comprised of an electrically insulative material such as Delrin. Back insulator 30 is open on each of two ends and includes a central bore 31 disposed therethrough. Central bore 31 is configured to allow a center conductor of a coaxial cable to pass therethrough. A first end of central bore 31 includes a flared edge 32 to allow for easier alignment of the center conductor of a coaxial cable to pass therethrough. A second end of said central bore 31 includes tapered end 33. Tapered end 33 is configured to receive a second end of a terminal 5 (not shown). A first end 35 of back insulator 30 is configured to be fit into third bore 13 of collar 10. The back insulator 30 provides for electrical and mechanical insulation of the center conductor of a coaxial cable from the collar 10.

Figure 6:
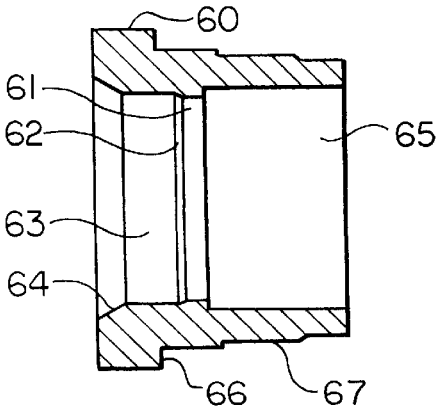
FIG. 6 is a cross-sectional view of the stem.
Figure 6A:
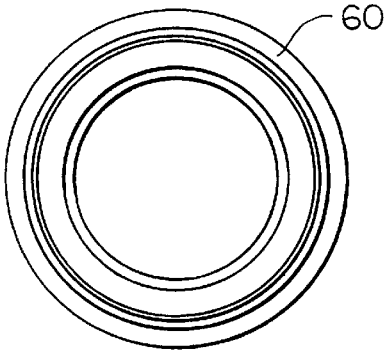
FIG. 6A is an end view of the stem of FIG. 6.

Stem 60 is shown in FIGS. 6 and 6A. Stem 60 is comprised of conductive material. Stem 60 is open on each of two ends and includes a first bore 61 disposed therethrough. A second bore 63 is disposed a predetermined distance from the first end of the stem 60. Second bore 63 is configured to receive insulator 40 therein. Second bore 63 includes a tapered edge 64 to allow for easier insertion of insulator 40 within stem 60. A third bore 65 is provided extending from a second end of stem 60 a predetermined distance into the stem.

Figure 7:
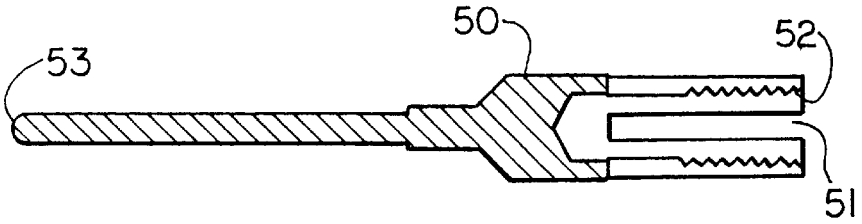
FIG. 7 is a cross-sectional view of the terminal.
Figure 7A:
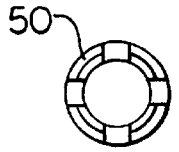
FIG. 7A is an end view of the terminal of FIG. 7.

Terminal 50, shown in FIGS. 7 and 7A, is comprised of brass or other conductive material. A first end of terminal 50 includes a cylindrical portion 53 for mating with a receiving connector. Terminal 50 is open on a second end and includes a bore 51 disposed therein. Bore 51 includes a plurality of serrations 52 for providing a secure connection to a center conductor of a coaxial cable.

Figure 8:
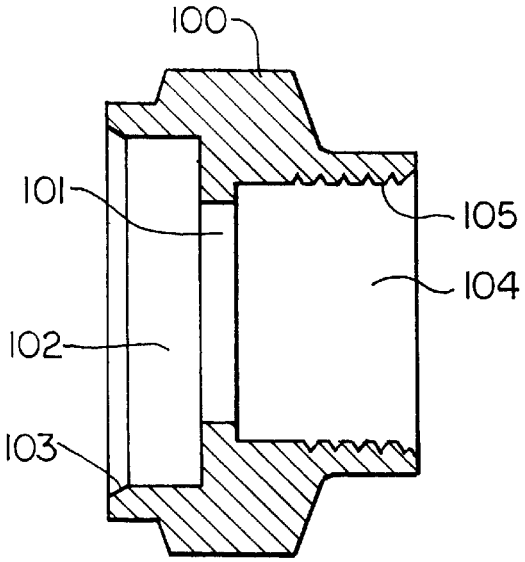
FIG. 8 is a cross-sectional view of the nut.
Figure 8A:
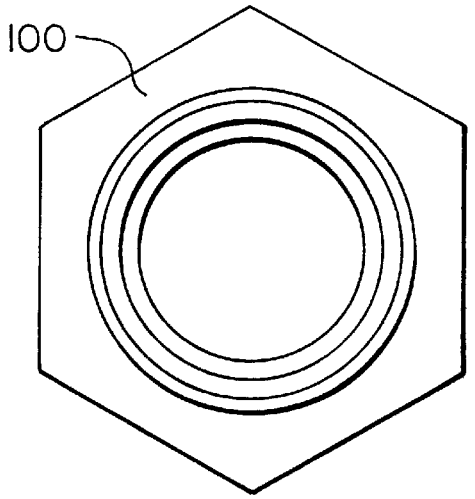
FIG. 8A is an end view of the nut of FIG. 8.

Referring now to FIGS. 8 and 8A a nut 100 is shown. Nut 100 is comprised of brass or other conductive material. Nut 100 has a first central bore 101 disposed therethrough, configured to receive stem 60 therein. A second bore 102 is disposed within a first end of nut 100 and is disposed a predetermined distance within nut 100. Second bore 102 is configured to receive a cooperating end of collar 10, and nut 100 is rotatable about the cooperating end of collar 10. A first end of bore 102 includes a tapered edge 103 to allow easier mating of nut 100 to collar 10. A third bore 104 is disposed within a second end of nut 100, and extends a predetermined distance therein. Third bore 104 includes a plurality of threads 105 for engaging a cooperating connector. A first o-ring 70 may be provided at the junction of nut 100 and collar 10.

Figure 9:
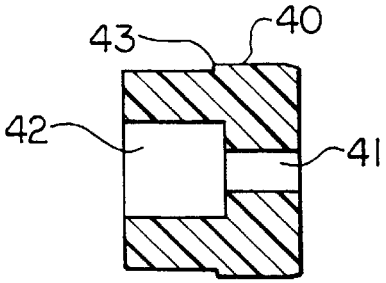
FIG. 9 is a cross-sectional view of the insulator.
Figure 9A:
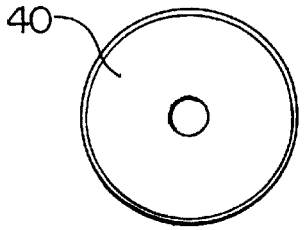
FIG. 9A is an end view of the insulator of FIG. 9.

FIGS. 9 and 9A show insulator 40. Insulator 40 is comprised of an insulative material such as Delrin. Insulator 40 has a first bore 41 extending therethrough. A second bore 42 extends from a first end of insulator 40 a predetermined distance therein. Insulator 40 includes an external surface 43 configured to be received within the central bore of stem 60. First bore 41 is configured to receive a first end of terminal 5 therethrough.

In use, a coaxial cable has had one end prepared for having the connector assembled onto. The prepared end of the coaxial cable is inserted into the second end of sleeve 20. The length of sleeve 20 provides cable strain relief as well as providing RF and environmental leakage protection. The prepared end of the coaxial cable passes through sleeve 20 and into the second end of collar 10. The prepared end of the coaxial cable is then fit onto the second end of post 90, such that the outer jacket and conductive shield of the coaxial cable are positioned along the exterior surface of the second end of post 90, and center conductor and dielectric insulator are disposed within the central bore of post 90. The center conductor of the coaxial cable is encircled by and extends beyond back insulator 30 where it is engageably received within the bore of terminal 50. Serrations within the central bore of terminal 50 make secure electrical and mechanical connection to the center conductor of the coaxial cable.

The connector is assembled by snap fit engaging collar 10 with sleeve 20. In this manner the coaxial cable is secured within connector 1 with the shield and jacket of the cable secured between the external surface of post 90 and the interior surface of sleeve 20. As a result of post 90 being configured to accommodate the stiffer polyethylene jacket of coaxial cables commonly used in Europe, the connector is easily installed onto the cable.

Protection against contaminates and a reduction of the degradation of RF signals are provided. Located along an outer surface of collar 10 is a first o-ring 70, and located along an outer surface of sleeve 20 is a second O-ring 80. Annular ridge 25 and o-rings 70 and 80 provide for a reduction in the degradation of RF signal performance between the connector pieces when they are mated together.

Additionally, the annular ridge 25 and the o-rings 70 and 80 serve to seal out contaminants that accelerate galvanic corrosion. The o-rings are comprised of a material which provides ultra-violet light (UV) and ozone stability for maximum resistance to atmospheric ingress. Accordingly, a secure electrical and mechanical connection between the coaxial cable and the connector 1 is provided.

The present connector is also extendable to include such applications as a flexible or drop cable, a splice connector, a feed through connector as well as including other cable sizes and types.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

We claim:

1. A snap together coaxial cable connector for polyethylene or other stiff jacketed coaxial cables comprising:

a collar open on each of two ends, having a bore centrally disposed therethrough, a first end having a first mating area, and a second end having a second mating area;

a sleeve open on each of two ends, having a bore centrally disposed therethrough, a first end configured to receive a coaxial cable, and an internal annular ridge;

a second end of said sleeve having a mating area that is snap fit engageable with the first mating area of the first end of said collar;

a threaded nut open on each of two ends, having a bore centrally disposed therethrough;

a first end of said nut disposed coaxially around and rotatable about the second mating area of said collar;

a back insulator open on each of a first end and a second end, having a central bore disposed therethrough;

said back insulator centrally disposed within said collar along a common longitudinal axis;

an insulator open on each of two ends, having a bore centrally disposed therethrough;

said insulator centrally disposed about a common longitudinal axis within said nut;

a terminal having a first end and a second end, having a bore partially disposed longitudinally therein at a second end;

said terminal centrally disposed along a common longitudinal axis within said nut, having the first end extending beyond a second end of said nut, and having the second end disposed within the second end of said back insulator;

said terminal bore having a plurality of serrations on an interior surface adjacent said bore second end;

a stem open on each of two ends, having a bore centrally disposed therethrough, and having said insulator centrally disposed therein;

said stem centrally disposed along a common longitudinal axis within the second end of said collar and the first end of said nut;

a post open on each of two ends, having a length less than approximately 0.5 inches, having a first end configured to receive a coaxial cable having a polyethylene jacket, and having a bore centrally disposed therethrough configured to receive a center conductor of a coaxial cable; and said post centrally disposed along a common longitudinal axis within said collar, and disposed within said collar such that the second end thereof abuts the first end of said back insulator;

wherein said sleeve is capable of mechanically securing a jacket and a sheath of a coaxial cable between an inner surface of said sleeve and an outer surface of said post when said sleeve is snap fit engaged with said collar.

2. The coaxial connector of claim 1 wherein said post has length of approximately 0.487 inches.

3. The coaxial connector of claim 1 further comprising a first o-ring recess annularly disposed along an outer surface of said sleeve, and having a first o-ring disposed therein.

4. The coaxial connector of claim 1 further comprising a second o-ring recess annularly disposed about an outer surface of said collar, and having a second o-ring disposed therein.

5. The coaxial connector of claim 1 wherein said sleeve, said insulator and said back insulator are comprised of Delrin.

6. The coaxial connector of claim 1 wherein said collar, said nut, said terminal and said post are comprised of electrically conductive material.

7. The coaxial connector of claim 6 wherein said collar and said nut are comprised of brass.

8. The coaxial connector of claim 6 wherein said terminal is comprised of a material selected from the group consisting of tin plated brass, silver plated brass and a copper alloy.

* * * * *

UNITED STATES PATENT AND TRADEMARK OFFICE

CERTIFICATE OF CORRECTION

PATENT NO. : 5,769,662
DATED : June 23, 1998
INVENTOR(S) : David J. Stabile et al.

It is certified that error appears in the above-identified patent and that said Letters Patent is hereby corrected as shown below:

Title page,
Item [60] Provisional Application reads "60/015,747, Apr. 9, 1996." should read -- 60/015,039, Apr. 9, 1996. --

Column 1,
Line 9, reads "60/015,747" should read -- 60/015,039 --

Signed and Sealed this

Twenty-ninth Day of January, 2002

*Attest:*

*Attesting Officer*

JAMES E. ROGAN
*Director of the United States Patent and Trademark Office*